United States Patent [19]

Maulini

[11] 3,941,170

[45] Mar. 2, 1976

[54] FEEDER FOR PACKAGING

[75] Inventor: Maurizio Maulini, Bologna, Italy

[73] Assignee: Azionaria Costruzioni Macchine Automatiche A.C.M.A. S.p.A., Bologna, Italy

[22] Filed: Dec. 26, 1973

[21] Appl. No.: 428,580

[30] Foreign Application Priority Data

Dec. 29, 1972 Italy ..... 3656/72

[52] U.S. Cl. ..... 141/183; 141/191

[51] Int. Cl.[2] ..... B65B 43/42

[58] Field of Search ..... 141/9, 10, 13, 100–107, 141/114, 163, 165, 166, 167, 168, 183–191, 237, 238, 242, 270, 283, 284

[56] References Cited

UNITED STATES PATENTS 2,932,330 4/1960 Donofrio ..... 141/238 X

*Primary Examiner*—Richard E. Aegerter
*Assistant Examiner*—Frederick R. Schmidt
*Attorney, Agent, or Firm*—Laurence A. Savage

[57] ABSTRACT

Feeder for packaging machines comprising a conveyor for transferring a number of containers which advance with intermittent motion and on which the containers receiving the portions of product are supported in parallel rows perpendicular to the direction of advancement of the conveyor. A flexible member is arranged in a closed path around a pair of pulleys of vertical axis so as to lie in a horizontal plane above the transfer conveyor and comprising two portions parallel to the rows of containers. A plurality of compartments are distributed along the flexible member at distances equal to that of the containers of each row and arranged to receive portions of product from portion delivery means disposed at said pulleys, and to discharge said portions by gravity through lower apertures closable by doors operated by control means.

6 Claims, 11 Drawing Figures

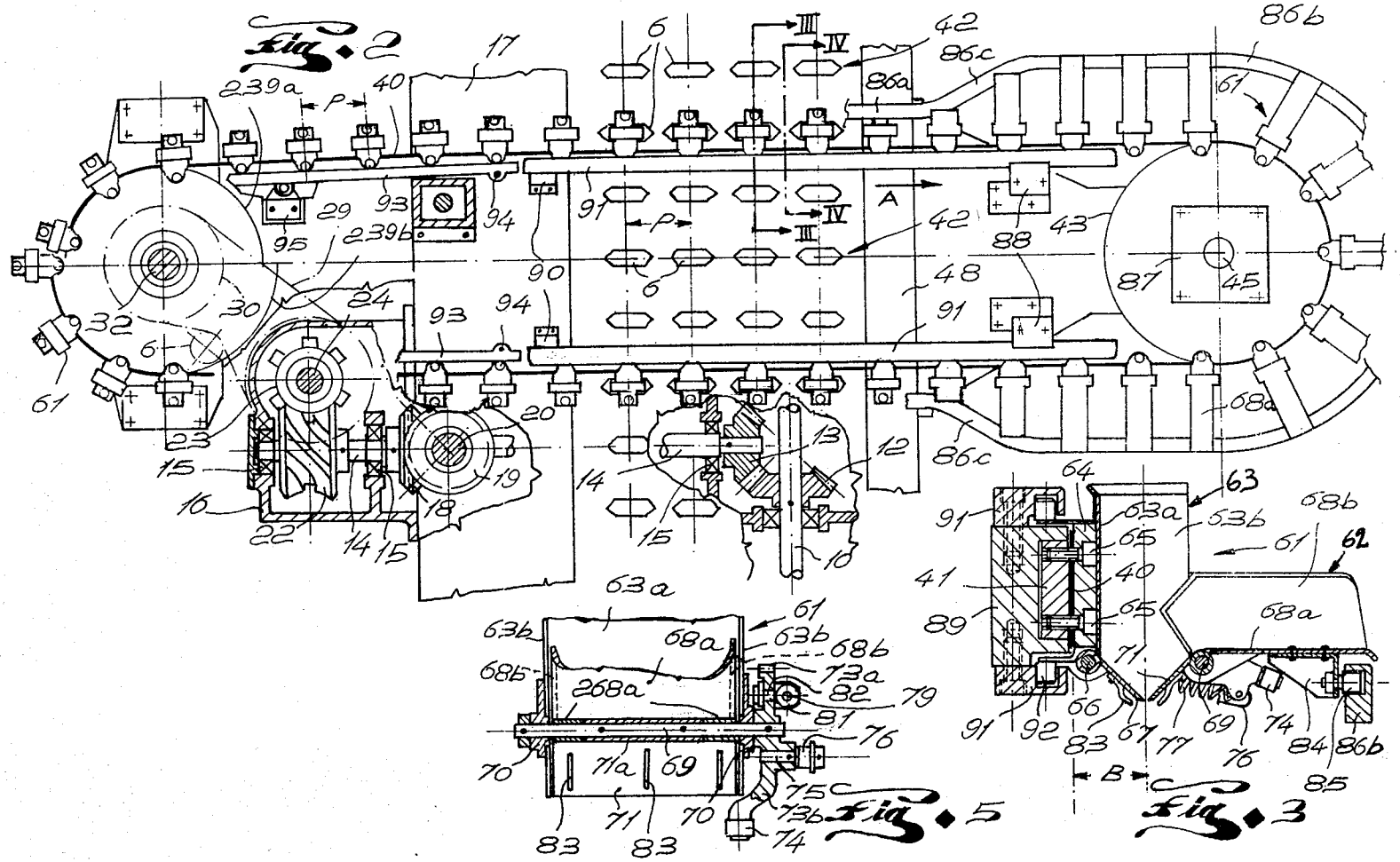

FEEDER FOR PACKAGING

BACKGROUND OF THE INVENTION

This invention relates to a feeder for simultaneously discharging a plurality of batches of fluent material into containers supported on a transfer conveyor of a packaging machine.

The object of this invention is to provide a feeder which permits the introduction into containers also of manually arranged products, which are difficult to slide or difficult to settle, such as slices of meat, chopped meat or fish. Moreover the feeder according to the invention must be easily adaptable to the format of the containers handled by the packaging machine.

SUMMARY OF THE INVENTION

This object is attained by a feeder for simultaneously discharging a plulrality of batches of fluent powdery or granular material into containers having an upper opening and supported on a transfer conveyor of a packaging machine in parallel rows perpendicular to the direction of travel of said transfer conveyor, said rows being equally spaced relative to each other, the containers in each row being spaced equally from one another and said transfer conveyor moving with intermittent motion with an advancing pitch equal to, or a multiple of, the spacing between two adjacent rows of containers, said feeder comprising a first pulley rotatably supported on a vertical axis on one side of said transfer conveyor, a second pulley rotatably supported on a vertical axis on the other side of said transfer conveyor, said first and second pulleys lying in the same plane above said transfer conveyor, a flexible member wound in a closed path on said first and second pulleys so as to have two parallel portions extending above said transfer conveyor and parallel to the rows of containers and two external portions extending on both sides with respect to said transfer conveyor, means for driving said flexible member with intermittent motion timed with the intermittent motion of the transfer conveyor, including an advance stroke equal to the distance between the containers of each row multiplied by the number of containers of a row and a dwell period, a plurality of upwardly open receptacles disposed on said flexible member at distances equal to the spacing of the containers of each row, said receptacles having lower discharge openings and said receptacles being arranged on said flexible member so that their lower openings along said parallel portions of the flexible member are in alignment with the upper openings of the containers, means for dispensing batches of material into those receptacles which are arranged on the external portions of the flexible member, doors supported on said receptacles for closing said lower discharge openings, and control means for operating said doors in timed relationship with said flexible member driving means, said control means opening said doors in response to said flexible member and said transfer conveyor being in the dwell period, during which dwell period the lower discharge openings of said receptacles are disposed above the upper openings in the containers.

BRIEF DESCRIPTION OF THE DRAWINGS

Further characteristics will be more evident from the description of a preferred embodiment of the feeder according to the invention, illustrated by way of example in the accompanying drawings in which:

FIG. 2 is a partially broken plan view of the feeder of FIG. 1;

FIG. 3 is a sectional view on the line III—III of FIG. 2;

FIG. 5 is a view substantially on the line V—V of FIG. 4;

DESCRIPTION OF THE PREFERRED EMBODIMENT

Figure 1:
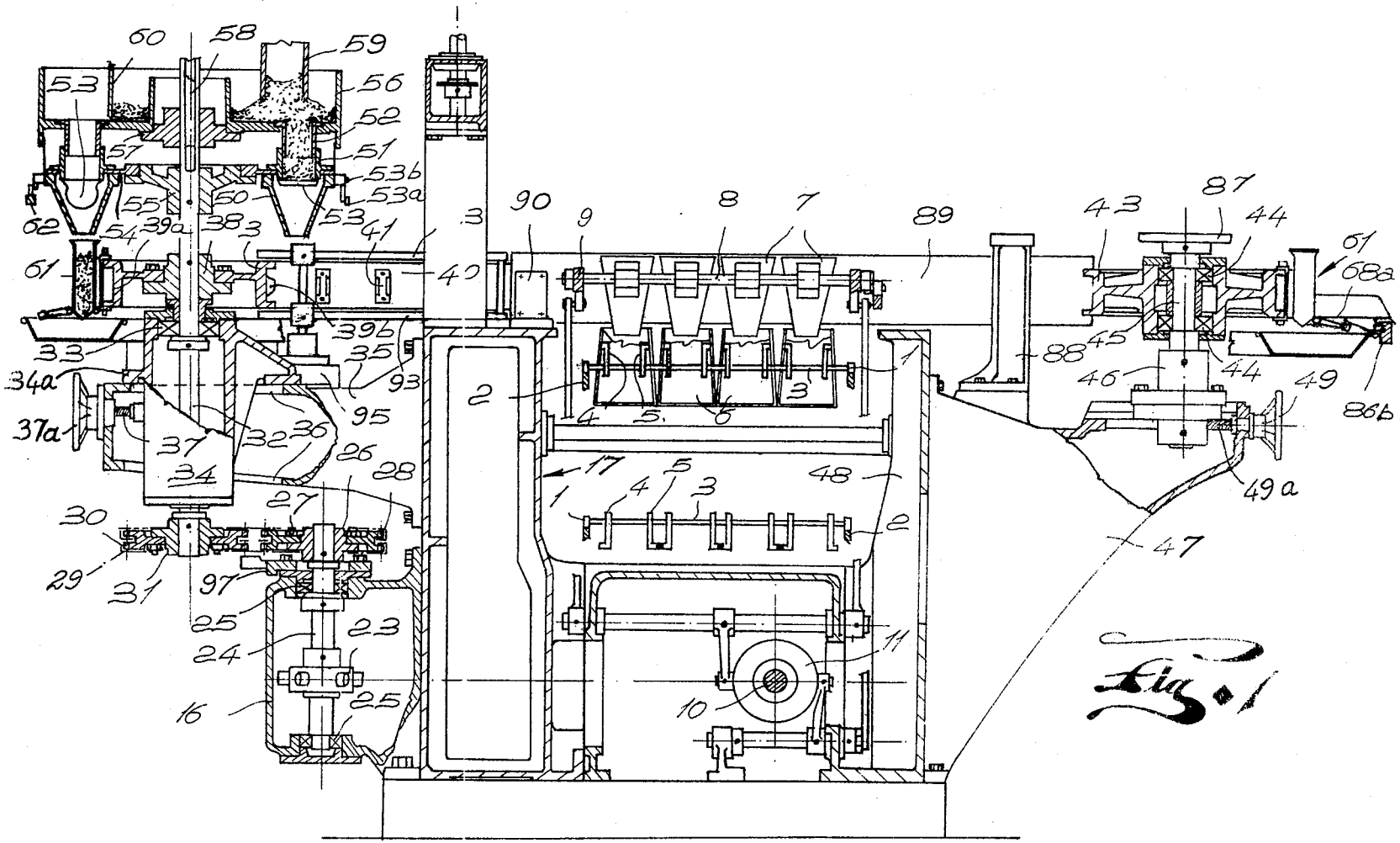
FIG. 1 is an elevational view of the feeder according to the invention in the form of a vertical section transverse to the packaging machine and longitudinal to the feeder itself.

FIGS. 1 and 2 show the two chains 1 of the transfer conveyor of the packaging machine, the support rails 2 for the upper and lower portions of said chains 1, pairs of shafts 3 which connect the two chains and are pivoted in these latter, and finally pairs of claws 4 and 5 of which the pairs of claws 4 are rotationally and axially rigid with the respective shafts 3, whereas the pairs of claws 5 are rotationally rigid but axially movable with respect to the adjacent pair of claws 4.

The pairs of claws 4, 5 grip the containers or envelopes 6 at their sides close to the opening for introducing the product. The structure and operation of these claws, and the method of introducing the material or product into the envelope 6 by hoppers 7 of the beak type, supported by shafts 8 which rest on a frame 9 have already been thoroughly described in the Italian patent No. 931,906 filed 26.5.1971 of the same applicant. As these parts do not constitute an object of the present invention, the reader is referred to the said Italian patent for a more detailed illustration. For an understanding of the apparatus according to the present invention it is sufficient to observe that the chains 1 are driven with intermittent motion by the cyclic drive shaft 10 through a transmission of the type disclosed hereinafter with reference to the parts 22–24, and the hoppers are controlled by cams 11 so as to make a pendular movement which partly accompanies the movement of advancement of the chains, during which the hoppers are introduced into the envelopes.

Figure 8:
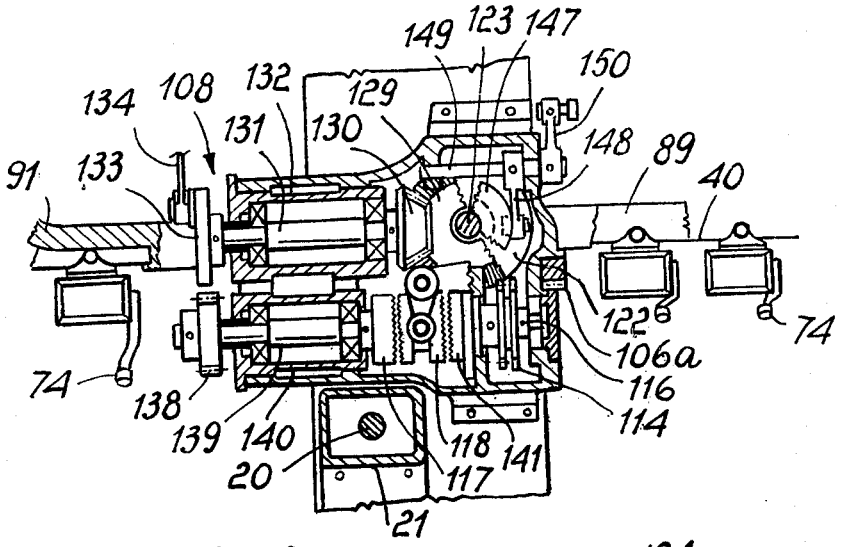
FIG. 8 is a horizontal section substantially on the line VIII—VIII of FIG. 6.
Figures 6, 10:
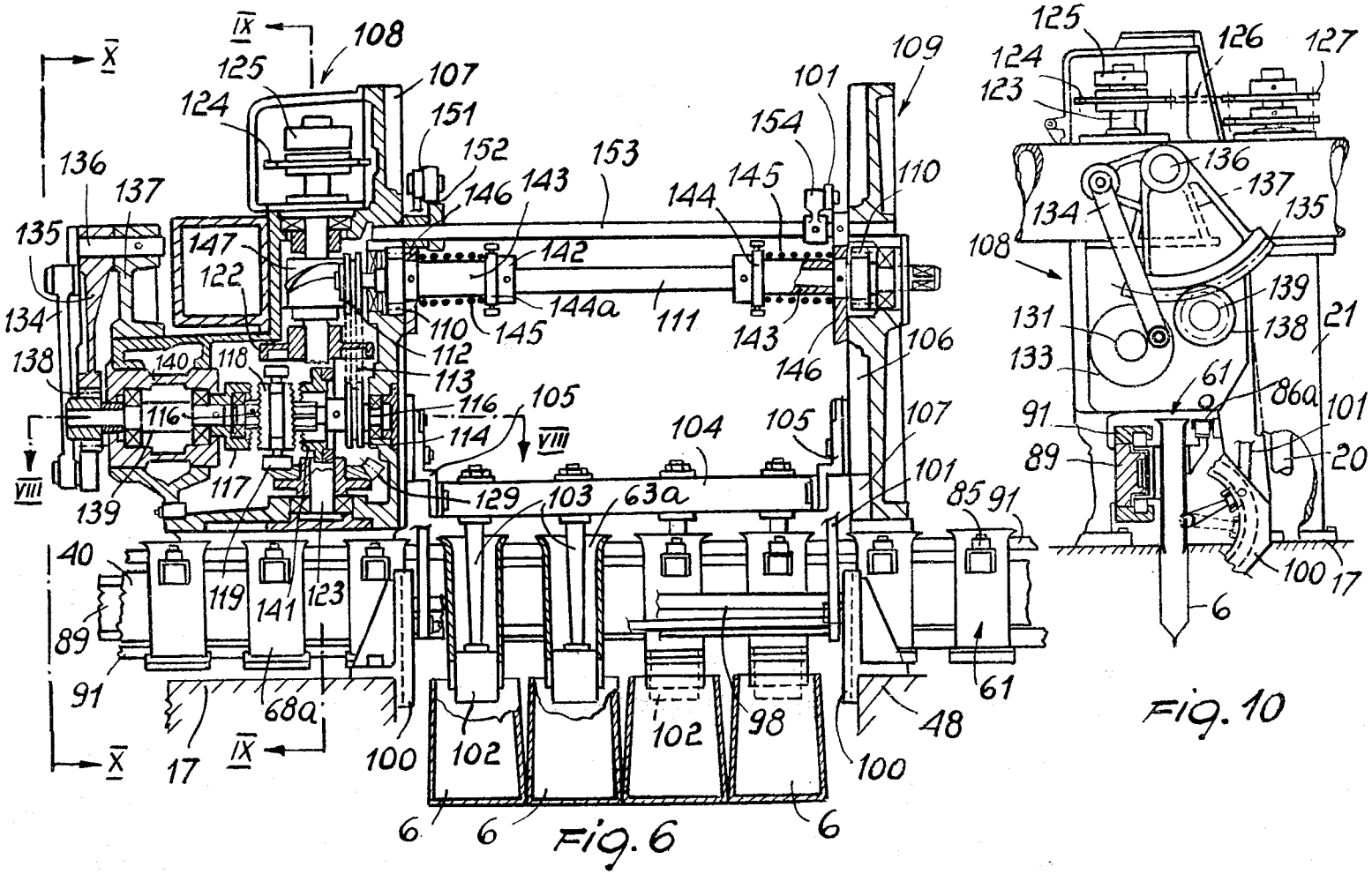
FIG. 6 is a vertical sectional view on a plane longitudinal to the feeder which shows means for positively expelling the portions from the compartments into the containers.
FIG. 10 is a side view taken on the line X—X of FIG. 6.
Figure 7:
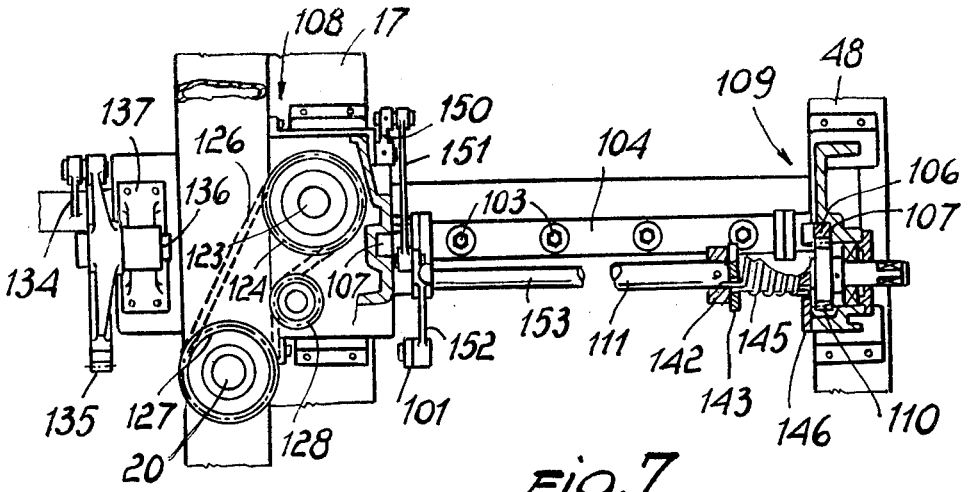
FIG. 7 is a partially broken sectional plan view of that shown in FIG. 6.

On the cyclic shaft 10 is keyed the bevel gear 12, FIG. 2, which meshes with the gear 13 keyed to one end of the shaft 14. This latter shaft is horizontal and transverse to the packaging machine, and by way of the bearings 15 is rotatably supported by the machine bench and by the housing 16, which is fixed projecting from one side 17 of the bench. To the shaft 14 is keyed the bevel gear 18, with which engages the bevel gear 19 keyed to the lower end of the vertical shaft 20. The shaft 20 (see also FIGS. 7, 8 and 10) is rotatably supported by the side 17 and by the tubular column 21 which rises from it.

The wheel 22 is keyed on the shaft 14 inside the housing 16 and comprises a plurality of suitably shaped grooves and sometimes known as Z or Fergusson type. The grooves are engaged by radial rollers distributed on the periphery of the wheel 23, which is fixed to the vertical shaft 24 supported rotatably by the housing 16 by means of the bearings 25.

The wheel 22 is substantially a globoidal wheel which comprises a plurality of grooves the inlet and outlet of each of which are angularly offset, and between the inlet and outlet, the groove has a circumferential development. It is evident that by means of the Z wheel 22 and the roller wheel 23, the continuous motion of the shaft 20 is transformed into an intermittent motion of the shaft 24 which stops when the rollers travel along the circumferential portion of the grooves, and rotates when the rollers travel along the portions close to the inlet and outlet of the grooves.

Consequently, as will be evident hereinafter, there is intermittent advancement of the flexible member of the feeder according to the invention with suitably gradual acceleration and deceleration. For each advancement of the flexible member the shaft 24 moves through 120° during the appropriate stage of a cycle of the packaging machine, a cycle corresponding to one advancement stroke and one dwell or standstill period of the chains 1.

On the upper end of the shaft 24 outside the housing 16 is fixed a sleeve 26 with a flange. The double ring gear 28 is fixed to this flange by screws 27. Round this ring gear winds the chain 29, which also winds around the double ring gear 30, which is fixed by screws to the flange of a sleeve 31, fixed to the lower end of the vertical shaft 32. The ring gears 28 and 30 mounted on the shafts 24 and 32 may be of different diameters accoring to the formats of the envelopes 6 to be filled. As will be seen hereinafter, the feeder according to the invention is provided with an assortment of these ring gears.

The shaft 32 is rotatably mounted by way of bearings 33 in the tubular support 34 which traverses the bracket 35 projecting from the side 17 through opposite openings or 36 which extend in the direction transverse to the packaging machine. The support 34 is provided with a peripheral shoulder **34*a* for resting on the bracket 35 and can be clamped to it in the desired position along these slots. The position of the support 34 is adjusted by a micrometer screw mechanism 37 controlled by the handwheel 37*a*. Above the support 34, a sleeve 38 is rigid with the shaft 32 and comprises an outer collar on which is fixed a driving pulley or wheel 39 for a flexible member consisting of a flexible metal band 40 extending in a closed path. The wheel 39 is interchangeable, as will be seen hereinafter, and for reasons of its assembly and replacement it is preferable for it to be divided diametrically into two parts. The periphery of the wheel is provided with a peripheral groove 39*a* for blocks 41 distributed along the inner surface of the belt 40 engaging the teeth 39*b* projecting from the bottom of the groove 39a. The pitch P of the teeth 39b and blocks 41 is equal to the pitch of the envelopes 6 which are aligned in rows or sets 42 transverse to the chains 1 of the transfer conveyor of the packaging machine. Proceeding intermittently in the direction of the arrow A, the band 40 winds on the return pulley or wheel 43, which, also provided with a peripheral groove, is idly supported by way of bearings 44 by the vertical shaft 45 fixed to the support 46. The support 46 is transversely adjustable on the bracket 47 fixed to the side 48 of the packaging machine bench by an adjustment mechanism composed of the screw 49a controlled by the handwheel 49**.

On the upper part of the shaft 32 is fixed a rotating dispensing head for fluent granular or powdery material, which comprises a set of funnels 50 with each of which is upperly aligned a pair of telescopic tubular portions or sleeves 51 and 52 constituting the batching elements adjustable as to their volume and of which the sleeves 52 are normally closed lowerly by doors 53. The sleeves 51 and funnels 50 are supported by a ring 54 which is centered and fixed on a plate 55 fixed to the shaft 32. The upper sleeves 52 extend from the bottom of an annular hopper 56. The hopper 56 is fixed to the collar of a sleeve 57 which is rigid with keys 58 slidable along respective axial grooves in the shaft 32. The material to be fed in portions reaches the hopper 56 from the stationary duct 59 so that during the rotation of the hooper and ring 54 rigid with the shaft 32, it fills the pairs of telescopic sleeves 51, 52 towards which it is deviated by stationary baffles and scrapers 60. The height of the hopper 56 with respect to the ring 54 and consequently the capacity of the pairs of sleeves 51, 52 and hence the quantity of the portions is adjusted by a manual control not shown.

Along the semicircle through which the funnels 50 accompany the band 40, the doors 53 are opened so that the portions of product contained in the sleeves fall into the underlying receptacles or compartments 61 of the band. The opening of the doors 53 is controlled by a stationary cam 62 which is engaged by the roller **53*a* carried by a lever rigid with the spindle 53*b* by which each of the caps 53 is hinged to the respective funnel 50. Between the spindle 53*b* and funnel 50 acts a spring which returns the cap into the position of closure of the respective sleeve 51 when the engagement between the cam 62 and roller 53*a*** ceases.

The compartments 61 are distributed along the band 40 at the same pitch P of the envelopes 6 and are fixed externally to it in positions corresponding with the blocks 41. It should be noted that the number of teeth **39*b* of the wheel 39 is equal to the number of funnels 50 and hence to the number of sleeves 51, 52** provided on the rotating feed head.

Figure 4:
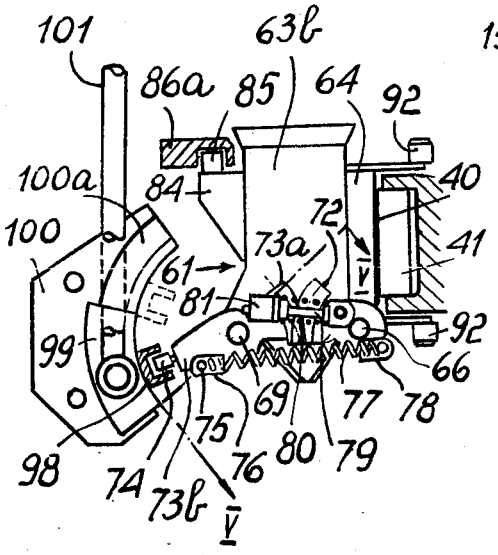
FIG. 4 is a side view of one of the compartments taken on the line IV—IV of FIG. 2.

With reference to FIGS. 3, 4 and 5, each compartment 61 consists of two parts 62, 63 consisting essentially of two sheet metal elements bent vertically to present a U-shaped section so that each defines a frontal wall **68*a*, 63*a* and two side walls 68*b*, 63*b* of which the lower end is triangular. To the frontal wall 63*a* is fixed the plate 64. The plate 64 is traversed by screws 65 which traverse corresponding holes in the band 40 and are screwed into the relative block 41 so as to fix to the band 40 both the block 41 and the compartment 61. Along the lower edge of the wall 63*a* is hinged the spindle 66, with which a flap door 67 is rigid, which lowerly closes one half of the bottom of the compartment and which abuts on the edges of the triangular end of the lateral walls 63*b*. The part 62 is hinged lowerly to the part 63 so that it may be turned outwards from a position internal to the part 63, in which the walls 68***b* and 63*b* are adjacent to each other. To enable the hinging, two bosses 268*a* are provided at the base of the frontal wall 68*a* and at its sides, and are traversed by a spindle 69 which is rotatably supported by supports 70 fixed externally to the walls 63*b* of the part 63 of the compartment. To the spindle 69, between the bosses 268*a*, is fixed the sleeve 71*a* to which is fixed the flap door 71 which closes the other half of the bottom of the compartment. To one end of the spindle 66 is fixed the toothed sector 72 (FIG. 4) which engages with the toothed sector 73*a* of a piece fixed to the other spindle 69 and which comprises an arm 73*b*, provided with a rotatable roller 74. To the arm 73*b* is fixed a pivot 75, to which is hinged the plate 76 into which the hooked the end of the spring 77 which acts by traction, and has its other end hooked in the plate 78 which is hinged to the sector 72. To this sector is also hinged a rod 79 which slides in a block 81 hinged by means of the pivot 82 (FIG. 5) to the toothed sector 73*a*. Between the block 81 and a shoulder of the rod acts a spring 80, which acts by compression. It should be noted that when the doors 67 and 71 are in the closed condition (FIGS. 3 and 4), the line which joins the centres of action of the spring 80, i.e. the points of hinging of the block 81 and rod 79, is above the common plane of the spindles 66 and 69, whereas the line which joins the centres of action of the spring 77 are below this plane. The springs 77 and 80 keep the doors in the closed position even when the compartments 61 contain the product which they have to supply to the envelopes 6. When said rollers 74 is operated so that it opens the doors, as will be seen hereinafter, as the doors are brought into the open condition said lines of action of the springs gradually approximate to the plane of the spindles 66, 69. In this manner, as the doors open and the springs become continually more loaded, the force which has to be exerted on the roller 74 progressively decreases.

Figure 9:
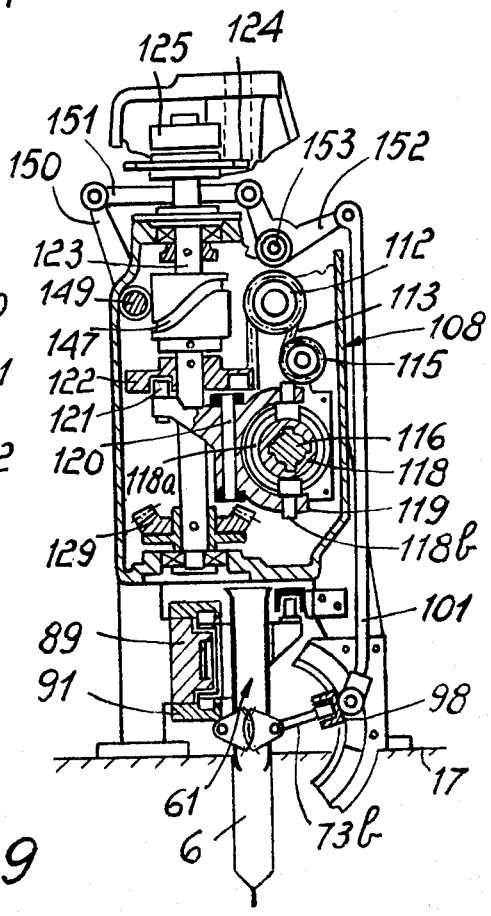
FIG. 9 is a vertical section on the line IX—IX of FIG. 6.

On the outside of the doors 67 and 71 are welded appendices 83 which have their lower ends spaced from the lower edges of the doors. When the doors open symmetrically (FIGS. 9 and 10) in order that the product contained in the respective compartment 61 maybe discharged into the underlying envelope 6, the appendices 83 engage from within the upper part of the envelope, which is thus not soiled by the product, so ensuring the perfect welding by which the envelope is closed after filling. The wall 68*a* of the second part of each compartment 61 is provided externally with the bracket 84 on which the roller 85 is rotatably supported. The rollers 85 of the various compartments engage the groove of a rail which extends along the path of the band 40 and which is fixed to the bench of the packaging machine. The portion 86*a* (FIG. 2 and 4) of this rail extends a short distance from the band 40 and the groove is open downwards so that the part 62 of the compartments is vertical. The portion 86*b* of the rail (FIGS. 2 and 3) extends at a greater distance from the band 40 than the portion 86*a*. It is further arranged at a lower level than that of the portions 86*a* and its groove is open towards the band 40 so that the part 62 along said portions 86*b* is upset outwards to assume a horizontal position. The portions 86*a* and 86*b* are connected by helical portions 86*c* (FIG. 2) for the rotation of the part 62 about the spindle 69. The portion 86*b* of the rail extends around the wheel 43 and parallel to the portions of the band 40 which are tangential to the wheel itself. Along these portions in which the part 62 is upset horizontally outwards it is possible to resolve particular feed problems for products to be introduced into envelopes. For example slices of meat to be introduced into the envelopes 6 can be disposed manually on the planes formed by the walls 68*a*. Obviously the product is placed by hand on the walls 68*a* during the dwells of the band 40, possibly also utilising part of the low acceleration and deceleration stages of the band. To facilitate the task of the operators responsible, an acoustic signal can be provided controlled by a microswitch controlled by a cyclic cam, which warns the operators a sufficient time before the beginning of the advancement of the band 40.

With the top of the fixed shaft 45 of the wheel 43 (FIG. 1) there is rigid a platform 87, which with the tops of the columns 88 rising from the bracket 47 define a support plane for weighing or batching devices or their parts.

The portions of the rail which are tangent to the band 40 of the wheel 43 are parallel to each other and transverse to the direction of advancement of the envelopes 6.

Furthermore said parallel band portions are spaced from one another so that the distance between the compartments arranged thereon is a multiple of the distance between the rows 42 of envelopes. The band 40 lies above the transfer conveyor and is synchronised with the packaging machine so that the chains 1 are in a dwell condition simultaneously with the band 40 and while the chains 1 advance the distance between two successive rows of envelopes, the band 40 advances with a pitch equal to the number of envelopes of a row multiplied by the pitch P.

At each dwell stage the compartments are thus able to discharge the product contained in them into the underlying envelopes, the compartments of the portion of the band 40 moving from the wheel 39 to the wheel 43 discharging the product received by the rotating feed head mounted on the shaft 32, and the compartments of the other portion moving from the wheel 43 to the wheel 39 discharging the product received during the path around the wheel 43.

Between the side 17 and wheel 43 the blocks 41 are guided in the groove of respective bars 89 (FIGS. 1 and 3) which are fixed to the colums 88 and to supports 90, mounted on the same side 17. Above and below each of these bars are fixed rails 91, which comprise guide channels for rollers 92 (FIG. 2, 3) which are rotatably supported by lugs projecting upperly and lowerly from the plate 64 of each compartment 61. This manner of guiding the compartments is particularly useful for neutralizing the forces which act on the compartments 61 when the product contained therein is discharged into the envelopes. At the portions of the band 40 tangential to the wheel 39, the rollers 92 of the compartments are unilaterally guided by pairs of shaped rails 93 (FIGS. 1, 2) which are hinged at one end to the spindle 94 supported vertically by the side 17, while at the other end they can be clamped to supports of the bracket 95. The rails 93 are necessary for ensuring positively that the central portions of the band 40 are parallel to each other and hence exactly perpendicular to the chains 1 of the packaging machine. In fact, as the wheel 43 has the same diameter for a large range of formats of envelopes 6, the wheel 39 must have different diameters lying between a minimum diameter 239*a* and a maximum diameter 239*b* (FIG. 2) according to the width of the envelopes, which necessitates a change in the pitch P.

The driving wheel 39 may also have a different number N of cavities defined between the teeth 39*b*. Obviously the maximum diameter of the wheel 39 may be greater than that of the wheel 43. In this case the rails 93 will converge towards the wheel 43. As the pitch p varies, the length of the band 40 also varies, this latter obviously having a length which is always an integral multiple of the pitch. Thus by suitably adjusting the position of the supports 34 and 46 on the brackets 35 and 47 in relation to the diameter of the wheel 39 and the length of the band 40, the compartments of the central portions of the band 40 are aligned with the envelopes of respective rows 42. Respective gear wheels 30 and 28 of different diameter must be mounted on the shafts 32 and 24 in accordance with the pitch P. The phase adjustment between the two shafts is obtained by adjusting the angular position in which the gear wheels are locked on the flanges of the sleeves 34 and 26. To enable this angular adjustment, the locking screws 27 traverse slots in the gear wheels 28, 30 which extend as an arc concentrically with these wheels. The chain 29 is tensioned by a sprocket 96 (FIG. 2) rotatably supported by a flange 97 (FIG. 1) which can be locked to the housing 16 by screws in an adjustable manner in order to suitably vary the tension of the chain.

In the following table the variable parameters indicated for operating on a number of envelopes 6 variable from three to eight and obtained from a band having a maximum width of 600 mm.

| N | D | n | P | n × P | R | $Z_1 : Z_2$ |
|---|---|---|---|---|---|---|
| | 510 | | 200 | 600 | | |
| 8 | | 3 | | | 9:8 | 90/80 |
| | 459 | | 180 | 540 | | |
| | 535 | | 186 | 559 | | |
| 9 | | 3 | | | 9:9 | 90/90 |
| | 459 | | 160 | 480 | | |
| | 535 | | 168 | 504 | | |
| | | 3 | | | 9:10 | 81/90 |
| | 459 | | 144 | 432 | | |
| 10 | | | | | | |
| | 477.4 | | 150 | 600 | | |
| | | 4 | | | 12:10 | 96/80 |
| | 459 | | 144 | 576 | | |
| | 525 | | 150 | 600 | | |
| 11 | | 4 | | | 12:11 | 96/88 |
| | 459 | | 131 | 524 | | |
| | 535 | | 140 | 560 | | |
| 12 | | 4 | | | 12:12 | 90/90 |
| | 459 | | 120 | 480 | | |
| | 535 | | 120 | 600 | | |
| 14 | | 5 | | | 15:14 | 90/84 |
| | 459 | | 103 | 515 | | |
| | 535 | | 105 | 525 | | |
| | | 5 | | | 15:16 | 90/96 |
| | 459 | | 90 | 450 | | |
| 16 | | | | | | |
| | 509 | | 100 | 600 | | |
| | | 6 | | | 18:16 | 90/80 |
| | 459 | | 90 | 540 | | |
| | 533 | | 93 | 558 | | |
| 18 | | 6 | | | 18:18 | 90/90 |
| | 459 | | 80 | 480 | | |
| | 535 | | 84 | 588 | | |
| | | 7 | | | 21:20 | 84/80 |
| | 459 | | 72 | 504 | | |
| 20 | | | | | | |
| | 477,4 | | 75 | 600 | | |
| | | 8 | | | 24:20 | 96/80 |
| | 459 | | 78 | 576 | | |

The table indicates the following: N indicates the number of batching elements 51 and 52 and correspondingly the number of cavities defined between the teeth 39*b* of the wheel 39; D indicates the pitch circle diameter in millimeters of the wheel 39, this diameter being calculated taking into account the thickness of the band 40; n indicates the number of envelopes 6 of each row 42; P indicates the pitch in millimeters of the envelopes of the same row and the pitch of the compartments 61 along the band 40; $n \times P$ indicates the width in millimeters necessary for the band; R indicates the transmission ratio between the wheels 28 and 30; $Z_1 : Z_2$ indicates the ratio of the teeth of these wheels. It should be noted that in this scheme, the assortment of wheels 28 and 30 with which the feeder according to the invention must be provided will comprise seven wheels having respectively 80, 81, 84, 88, 90 (two wheels) and 96 teeth. These wheels are suitable for a chain 29 of one-half inch.

Figure 11:
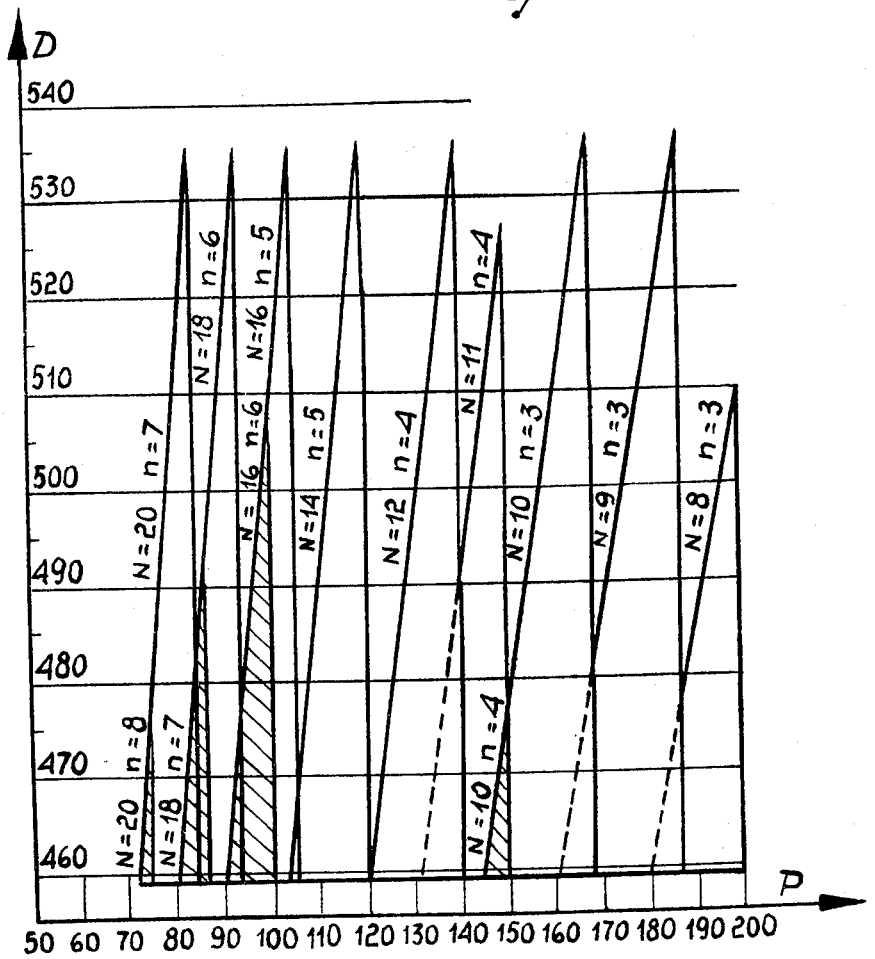
FIG. 11 shows a diagram which enables the user of the packaging machine to identify the working parameters for the feeder of the invention, according to the formats of the containers to be filled.

The diagram of FIG. 11 represents the data of the previous table, showing also the possible alternative choices which the user of the packaging machine has. The abscissas and ordinates indicate respectively the values of P and D. From the above it is clear that where possible, it is preferable to change the capacity of the envelopes by varying their height rather than their width, because the varying of the height of the envelopes does not involve adjusting or varying in any way the feeder according to the invention in itself.

Between the sides 17, 48 and parallel to the central portions of the band 40 is disposed a pair of rails 98 which each define a channel facing the compartments 61. The ends of each rail 98 are rigid with sectors of rings 99 which are guided in grooves 100*a* formed in a plate 100 and extending in a circle having the spindle 69 as its center. The plates 100 are rigid with supports fixed to the sides 17 and 48 (see also FIGS. 6, 9 and 10). To the sectors 99 are hinged the lower ends of respective vertical rods 101 driven with reciprocating motion so as to move the rails 98 from the lowered position shown in FIG. 4 to the raised position of FIG. 9. When the rails are lowered, the channels of the rails are engaged at each movement of advancement of the band 40 by the rollers 74 of the row of compartments which move on the conveyor 1. When the compartments are in the halt position, above the respective row of envelopes the rails 98 are made to rise, so causing the doors 67, 71 to open and the product contained in the compartments to be introduced into the envelopes.

If, as stated, the compartments 61 have received slices of meat or other products which have poor sliding or settling properties (such as chopped meat or fish), it is necessary for the products to be positively thrust into the envelopes until they reach the required depth. This is done by a series of pushers comprising pistons 102 (FIGS. 6 and 7) rigid with the lower end of respective rods 103, which project downwards from a horizontal beam 104 transverse to the packaging machine. Bars 106 are connected by brackets 105 to the ends of the beam 104, and are slidably guided in relative vertical cavities 107 formed one opposing the other in a side wall of the box or housing 108 and in the frame 109 (see also FIGS. 8, 9 and 10). The bases of the frame 109 and box 108 are respectively fixed to the sides 48 and 17 of the packaging machine, and are shaped lowerly in the form of a bridge in order to leave a free passage for the portion of the band 40 which extends from the wheel 43 to the wheel 39. Each bar 106 has on one face a rack 106*a* (FIG. 8) which engages with a sprocket 110 (FIG. 6) keyed to the end of a transverse shaft 111, which is rotatably supported by the frame 109 and by the box 108. The end of the shaft 111 projects to the inside of the box and carries keyed on it the gear wheel 112, which by way of the chain 113 (FIG. 6, 9) is driven by the gear wheel 114. The tension of the chain 113 is adjusted by a sprocket 115. The wheel 114 is rigid with the transverse shaft 116, which at its two ends is rotatably supported by the box 108 in a sleeve 117, which at its front comprises a coupling ring with triangular teeth. The central portion of the shaft 116 is grooved and on it is slidable a body 118 which on both its frontal faces is provided with coupling teething and is provided centrally with an annular groove 118*a*. In this groove are engaged two blocks 118*b* hinged at the two arms of a fork 119. This fork is mounted in an oscillating manner on a vertical shaft 120, supported inside the box 108. An appendix of the fork 119 rotatably supports a roller 121, which engages the endless channel of a cam 122. The cam is fixed to a vertical shaft 123, which is rotatably supported by the box 108 and which makes one revolution for each cycle of the packaging machine. On the upper portion of the shaft 123 is rotatably mounted the gear wheel 124, which can be made rigid with the shaft itself by operating a coupling 125 which is fixed to it and which is made operable during a precise working stage. When the coupling 125 is operated, the shaft 123 is driven by the shaft 20 by means of a chain 126 which winds around the wheel 124 and around one of the wheels 127 keyed on to the shaft, 20, and which is tensioned by the tensioning sprocket 128. With the lower end of the shaft 123 is rigid the bevel gear 129 (FIG. 8), which engages with the pinion 130 keyed to one end of the transverse shaft 131, which is rotatably supported by a sleeve with a flange 132, seated and fixed in the box 108. It should be noted that the transmission ratio of the bevel gear pair 129, 130 is such that while the shaft 123 makes one revolution per cycle, the shaft 131 makes two. The disc 133 is keyed to the shaft 131 outside the box 108, and to it is eccentrically hinged one end of the connecting rod 134, the other end of which is hinged to an arm of the toothed sector 135. This sector is mounted in an oscillating manner at 136 to a support 137, fixed to the box 108, and engages with the sprocket 138. The sprocket 138 is keyed to the end of a shaft 139, which is coaxial with the shaft 116 and is mounted rotatably in the sleeve with the flange 140, seated and fixed in the box, and the sleeve with coupling ring 117 is rigid with its other end. Thus for each cycle of the packaging machine, the sleeve 117 makes two oscillations in one direction and the other.

In one cycle of the packaging machine, the body 118, controlled by the cam 122, makes on the grooved shaft 116 a single stroke in one direction and a single stroke in the other. The two strokes are of very small extent and take place when the sleeve 117 is always at the same end of stroke. At one end of its stroke, the body 118 is coupled with the sleeve 117 and hence the pistons 102 descent into the compartments 61 and then rise above them. At the other end of its stroke the body 118 is coupled with the frontal toothing of a ring 141, centred and fixed to a rib of the box 108, so that the pistons 102 retain in their raised position for 180° of the cycle of the packaging machine, because of which the band 40 makes a movement of advancement. In practice this advancement may begin as soon as the pistons 102, in their upward stroke, have left the compartments 61 so as to have a greater time available than that corresponding to 180° of the cycle. By suitably choosing the dimensions and number of triangular teeth of the three couplings 117, 118 and 141 and also the eccentricity of the hinging of the connecting rod 134 to the disc 133, one predetermined tooth of a front face of the body 118 can always be made to penetrate between two predetermined teeth of the ring 141, and likewise a tooth of the other front face of the body 118 can always be made to penetrate between two predetermined teeth of the sleeve 117.

Obviously, when the body 118 is in the middle position, there is no engagement with the teeth of the sleeve 117 and ring 141, and the coupling takes place only when the body 118 is at the respective end of its stroke.

It should be noted that between each sprocket 110 and shoulders 142 of the shaft 111 bushings 143 are rotatably arranged having their ends near said shoulders provided with collars 144a in which screws 144 are radially screwed for clamping these bushings 143 to the shaft 111 in an appropriate mutual angular position, as will be seen hereinafter. To the collars 144a are anchored the ends of torsion springs 145 which are arranged on the bushings 143 and have their other ends anchored to rings 146 fixed one to the frame 109 and the other to the side wall of the box 108. The angular locking position of the bushings 143 on the shaft 111 is that in which the springs are loaded so as to balance the weight of the parts connected to the beam 104. The locking of the bushings 143 is carried out while the beam is in its high position, the body 118 has been disengaged from the ring 141 and the hinging pivot between the sector 135 and connecting rod 134 has been removed. In this manner, during the operation of the feeder according to the invention, the thrusts on the group of couplings 117, 118, and 141 are considerably reduced, both during the stage in which the pistons 102 are at rest in the raised position and during the stage in which the body 118 is coupled to the sleeve 117 to provide the up and down movement of the pistons. On the shaft 123 is keyed an axial cam 147, in which is engaged the roller of a lever 148 fixed to a shaft 149. The shaft is mounted in an oscillating manner in ribs of the box 108 and externally to this it rigidly carries the lever 150, to which is hinged one end of the tie rod 151. The other end of the tie rod is hinged to an arm of the angular level 152, the other arm of which is hinged to the top of one of the rods 101 which control the rail 98. The lever 152 is fixed to a transverse shaft 153 rotatably carried by the frame 109 and box 108. With the shaft 153 is also rigid a lever 154 to which is hinged the top of the other rod 101 controlling the rail 98. In this manner the axial cam 147 controls the oscillations and halt stages upwards and downwards of the rail 98 and hence of the doors of the compartments 61, from which the envelopes 6 receive the batches of product.

I claim:

1. A feeder for simultaneously discharging a plurality of batches of fluent powdery or granular material into containers having an upper opening, comprising:

a transfer conveyor, means for supporting said containers on said transfer conveyor in parallel rows perpendicular to the direction of travel of said transfer conveyor, said rows being equally spaced relative to each other, the containers in each row being equally spaced from one another, means for moving said transfer conveyor with intermittent motion with an advancing pitch equal to, or a multiple of, the spacing between two adjacent rows of containers, a first pulley rotatably supported on a vertical axis on one side of said transfer conveyor, a second pulley rotatably supported on a vertical axis on the other side of said transfer conveyor, said first and second pulley lying in the same plane above said transfer conveyor, a flexible member wound in a closed path on said first and second pulley so as to have two parallel portions extending above said transfer conveyor and parallel to the rows of containers and two external portions extending on both sides with respect to said transfer conveyor, means for driving said flexible member with intermittent motion timed with the intermittent motion of the transfer conveyor, including means for producing an advance stroke equal to the distance between the containers of each row multiplied by the number of containers of a row and a dwell period, a plurality of upwardly open receptacles disposed on said flexible member and spaced at distances equal to the spacing of the containers of each row, said receptacles having lower discharge openings and said receptacles being arranged on said flexible member so that said lower discharge openings along said parallel portions of said flexible member are in alignment with the upper openings of the containers, means for dispensing batches of material into those receptacles which are arranged on the external portions of the flexible member, doors supported on said receptacles for closing said lower discharge openings, and control means for operating said doors in timed relationship with said flexible member driving means, said control means opening said doors in response to said flexible member and said transfer conveyor being in the dwell period, during which dwell period the lower discharge openings of said receptacles are disposed above the upper openings of the containers.

2. A feeder as defined in claim 1, wherein at least one of said pulleys is interchangeably supported on a vertical shaft, means being further provided for adjusting the position of said shaft with respect to the transfer conveyor according to the diameter of said pulley.

3. A feeder as defined in claim 1, wherein the doors which close the lower openings of said receptacles are supported at the bottom of the receptacles on a hinge axis parallel to the advance direction of said flexible member and comprise an arm rigid with the respective door and having an end extending outwards, the door control means comprising a pair of horizontal rails extending transversely to the transfer conveyor, grooves formed in said rails into which the ends of the arms of those receptacles penetrate whose discharge openings during dwell periods of said flexible member are disposed above the upper openings of said containers, ring sectors rigid with said rails and guided in a circular path whose center lies on said hinge axis and driving means for driving said rails with receiprocating motion between two positions corresponding to the position of closure and opening of the doors.

4. A feeder as defined in claim 3, wherein each receptacle comprises a first part fixed to the flexible member and supporting said door and a second part hinged at the bottom of said first part on an axis parallel to the hinge axis of said door, a roller supported on said second part and engaging a stationary cam extending along the path of said flexible member, said cam causing upsetting of said second part along one external portion of said flexible member.

5. A feeder as defined in claim 1, wherein at least one of said pulleys is supported on a shaft and said means for dispensing batches of material comprises a rotating head provided with batching elements distributed peripherally about its axis of rotation, said head being mounted coaxially on said shaft on which one of said pulleys is supported.

6. A feeder as defined in claim 1, additionally comprising a horizontal beam arranged perpendicularly to and above said transfer conveyor, a plurality of pushers of number equal to the number of containers of each row fixed on said beam and projecting downwardly, said pushers being aligned with the receptacle during the dwell period of the flexible member, means for vertically driving said beam with reciprocating motion between a position in which said pushers are external above said receptacles and a position in which the pushers have penetrated into the receptacles for dispensing the batches of material contained therein into the underlying containers.

* * * * *